US009121595B2

(12) United States Patent
Erion

(10) Patent No.: US 9,121,595 B2
(45) Date of Patent: Sep. 1, 2015

(54) LED LIGHTING DEVICE AND SYSTEM

(76) Inventor: Jeffrey Allen Erion, Plymouth, MI (US)

( * ) Notice: Subject to any disclaimer, the term of this patent is extended or adjusted under 35 U.S.C. 154(b) by 43 days.

(21) Appl. No.: 13/592,309

(22) Filed: Aug. 22, 2012

(65) Prior Publication Data

US 2013/0258659 A1 Oct. 3, 2013

Related U.S. Application Data

(63) Continuation-in-part of application No. 12/906,499, filed on Oct. 18, 2010.

(51) Int. Cl.

| | |
|---|---|
| ***F21V 29/00*** | (2015.01) |
| ***F21V 5/04*** | (2006.01) |
| ***F21V 23/00*** | (2015.01) |
| ***F21V 31/00*** | (2006.01) |
| ***F21V 29/74*** | (2015.01) |
| *F21V 7/00* | (2006.01) |
| *F21Y 101/02* | (2006.01) |
| *F21Y 103/00* | (2006.01) |

(52) U.S. Cl.

CPC ..... *F21V 29/2206* (2013.01); *F21V 5/04* (2013.01); *F21V 23/009* (2013.01); *F21V 29/74* (2013.01); *F21V 31/005* (2013.01); *F21V 5/043* (2013.01); *F21V 7/0091* (2013.01); *F21Y 2101/02* (2013.01); *F21Y 2103/003* (2013.01)

(58) Field of Classification Search

CPC ..... F21V 29/2206; F21V 5/04; F21V 5/043; F21V 23/009; F21V 29/74; F21V 31/005; F21V 7/0091; F21Y 2103/003; F21Y 2101/02

USPC ..... 362/218–223, 217.3, 294, 345, 373

See application file for complete search history.

(56) References Cited

U.S. PATENT DOCUMENTS

| | | | | |
|---|---|---|---|---|
| 6,481,130 | B1 | 11/2002 | Wu | |
| 6,634,779 | B2 | 10/2003 | Reed | |
| 6,641,284 | B2 | 11/2003 | Stopa et al. | |
| 6,776,504 | B2 | 8/2004 | Sloan et al. | |
| 6,680,628 | B2 | 1/2005 | Robertson et al. | |
| 6,880,952 | B2 | 4/2005 | Kiraly et al. | |
| 7,008,079 | B2 | 3/2006 | Smith | |
| 7,114,830 | B2 | 10/2006 | Robertson et al. | |
| 7,159,997 | B2 | 1/2007 | Reo et al. | |
| 7,244,058 | B2 | 7/2007 | DiPenti et al. | |
| 8,093,823 | B1 | 1/2012 | Ivey et al. | |
| 8,585,245 | B2 * | 11/2013 | Black et al. | 362/267 |
| 2005/0201098 | A1 | 9/2005 | DiPenti et al. | |
| 2007/0058377 | A1 * | 3/2007 | Zampini et al. | 362/372 |
| 2008/0037239 | A1 | 2/2008 | Thomas et al. | |
| 2009/0168419 | A1 | 7/2009 | Daimon | |
| 2009/0190350 | A1 | 7/2009 | Tseng et al. | |
| 2009/0219713 | A1 | 9/2009 | Siemiet et al. | |

* cited by examiner

*Primary Examiner* — Thomas M Sember

(74) *Attorney, Agent, or Firm* — The Bilicki Law Firm, P.C.

(57) ABSTRACT

A lighting device includes a support structure formed from a thermally conductive material such as aluminum. The support structure or extrusion has a channel for receiving and retaining a circuit board with a plurality of light emitting diodes (LEDs) disposed thereon. One or more fins adapted for dissipating heat produced by the LEDs may be disposed on the support structure. The support structure may also comprise multiple arrays of LEDs arranged laterally.

20 Claims, 2 Drawing Sheets

LED LIGHTING DEVICE AND SYSTEM

This application is a continuation-in-part of U.S. patent application Ser. No. 12/906,499, filed Oct. 18, 2010.

TECHNICAL FIELD

The disclosure generally relates to LED lighting devices and systems and support structures for such devices and systems.

BRIEF DESCRIPTION OF THE DRAWINGS

Embodiments of the invention are disclosed in the included drawing figures and illustrations. It is understood that the illustrated embodiments are not intended to limit the scope of the invention to the specific embodiments disclosed. On the contrary, the invention is intended to cover alternatives, modifications and equivalents, which may be included within the spirit and scope of the invention.

DETAILED DESCRIPTION

Figure 1:
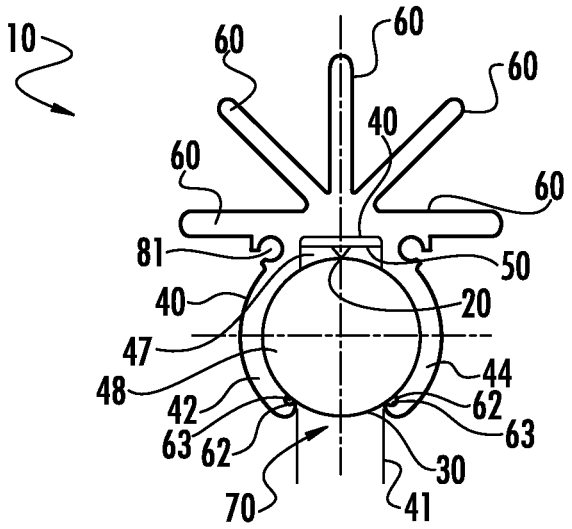
FIG. 1 illustrates a cross sectional view of an embodiment of a lighting device in accordance with teachings of the present disclosure utilizing a circular optical element.

As generally illustrated in FIG. 1, an embodiment of an LED lighting device 10 includes, inter alia, at least one light emitting diode (LED) 20, an optical element 30, and a support structure 40. Embodiments of LED lighting device 10 can also include a plurality of LEDs that may be provided as part of, or in the form of, a printed circuit board (PCB) array, LED strip, or substrate, generally indicated at 50. In one embodiment, a linear string of white LEDs 20 may be mounted to a PCB. FIG. 1 illustrates a principally round optic 30; however, other forms of optical elements may also be used to permit flexibility in beam shaping. That is, optical element 30 may, without limitation, comprise a round rod, a triangulated rod, a rectangular rod, or rod of any shape known in the art. Moreover, the optical element 30 may be a clear rod, a translucent rod, a colored rod, or a total internal reflection (TIR) lens. In embodiments, the optical element may be comprised of, without limitation, acrylic or glass. One of skill in the art will appreciate that optical elements of diverse shapes and materials may be utilized in the current device.

LED lighting device 10 includes support structure 40 having a plurality of protrusions or fins 60 that may be configured to provide a measure of thermal control, such as heat dissipation. By taking into account the power or heat associated with the LED 20 or LED strip 50, the protrusions or fins 60 can be configured to adequately handle the associated heat transfer. That is, the protrusion or fins 60 may be configured to assist in pulling heat from individual LEDs and to spread the heat laterally.

In embodiments, the device includes a plurality of LEDs 20. The LEDs may be white or colored. Further, some embodiments may employ a multi-color chip (e.g., on comprising RGB LEDs) that permits LED lighting device 10 to effectively emit almost any desired color of light. In a particular embodiment, the centers of the LEDs 20 may be arranged in a line. The spacing and cumulative flux of the LEDs may be used to establish the total illumination supplied to an area or surface to be illuminated. It is noted that a channel or opening, i.e. a receiving area 47, may be created in a portion of the support structure 40 to permit the LEDs (which may be on a PCB) to be positioned sufficiently precisely relative to optical element 30. Receiving area 47 is thus provided for retaining and receiving an LED substrate 50 within support structure 40. In addition, optical channel 48 is also provided within support structure 40 for receiving optical element 30.

As generally illustrated in FIG. 1, the support structure 40 is configured to hold or retain optical element 30. In the illustrated embodiment, light emitted by the LED may be transmitted through an opening 41 associated with the support structure 40 such as that generally illustrated by arrow 70 in FIG. 1. The dispersion (e.g., angle) of the light 21 emitted by the LED 20 and passing through the optical element 30 may be controlled by (a) the distance between the LED 20 and the optical element 30, and/or (b) modification of the opening 41 associated with the support structure 40. That is, the width of the pattern of light to be delivered to a surface or area may be determined by the shape of the optical element (e.g., transparent light rod), the area of optical element exposed at the light exit, and the position of the optical element in relation to the line of LEDs. A narrow opening in connection with an associated support structure 40 or outer housing will create a narrow beam of light; a wider opening will allow a wider beam of light. The closer the optical element 30 is positioned to the LEDs 20, the wider the beam pattern; the further away, the narrower the beam pattern. Beyond a certain point, the beam becomes unfocused. Notably, for a number of embodiments, the LED 20 will be spaced very closely to the optical element 30, for example and without limitation, within about 0.010 to 0.020 inches.

Additionally, without limitation, in an embodiment the optical element 30 is enclosed by an extruded metal support structure 40, which provides support to the optical element, as well as accurate positioning in relation to LEDs 20. Support structure 40 may be a metal extrusion formed from a single piece or may be formed from a plurality of extrusions joined to form a singular structure. Support structure/housing 40 may include opposing support segments or portions, e.g., 42 and 44, that at least in part form an optical channel 48 there between into which the optical element 30 may be received. In an embodiment in which the optical element 30 comprises a rod, the opposing support segments 42 and 44 provide optical channel 48 into which the rod may, for instance, be slid into and retained via retaining features (not shown in FIG. 1). Opposing support segments 42 and 44 may be configured such that optical channel 48 is circular, semi-circular, a rectangular, or triangular for accommodating a similarly shaped optical element 30.

Also shown in FIG. 1, a pair of semi-circular grooves 62 provided at terminating ends of support structure 40, function as sealing channels for a sealing element 63. Sealing element 63 may comprise an o-ring, or any other sealing element known in the art such as a gasket, bellows, sealing wedge, or diaphragm. Sealing element 63 is installed following the assembly of optical element 30, by rolling sealing element 63 into position so that it lies between optical element 30 and support structure 40. Ends of sealing element 63 are subsequently trimmed following installation, to allow end caps to be installed thereafter. Finally, thread-forming screws are provided at a pair of semi-circular cavities 81 disposed at either side of support structure 40 to thereby complete assembly of LED lighting device 10. Semi-circular cavities 81 may include interior threaded portions for securing the end caps thereon.

Further, in embodiments, the support structure 40, which may include one or more protrusions or fins 60, may be formed integrally, e.g., via an extrusion process. This can permit the process of forming support structures to be fairly continuous and efficient from a production standpoint. In an embodiment, the support structure 40 may be, for example, comprised of aluminum. However, various other materials that are suitable for the intended environment and/or associated production techniques may be employed. It is noted that the disclosed structure, and the associated forms of processing—e.g., extrusion, supports both the array/strip 50 with the LEDs 20 and consequently provides and maintains a consistent relative positioning (which can be very important) between the LED and the optical element. The structure can further provide an integrated thermal control and/or protective structure for LED lighting device 10.

Figure 2:
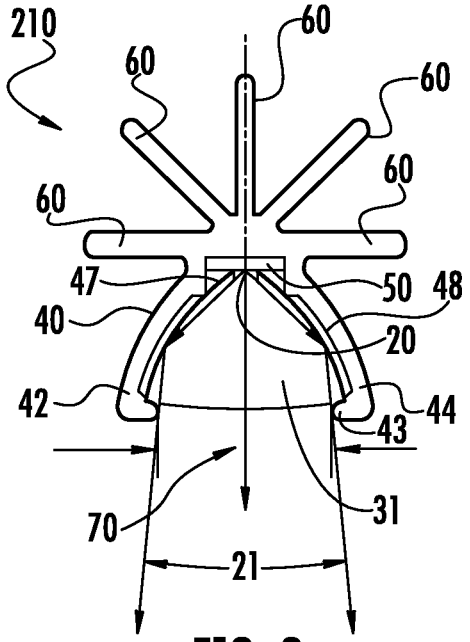
FIG. 2 illustrates a cross sectional view of another embodiment of a lighting device in accordance with teachings of the present disclosure, utilizing a triangulated optical element.

FIG. 2 generally illustrates a cross sectional view of another embodiment of a lighting device 210 that includes the use of a total internal reflection (TIR) optic 31. The TIR optic 31 is extruded or molded in the same fashion as optical element 30 in FIG. 1. However, the shape of TIR optic 31 allows it to collect more of the light emitted from LED strip or substrate 50, and to control spread of this light, by manipulating the surfaces of TIR optic 31. Retaining elements 43 are formed at terminal ends of opposing support segments 42 and 44 for retaining optic 31.

Figure 3:
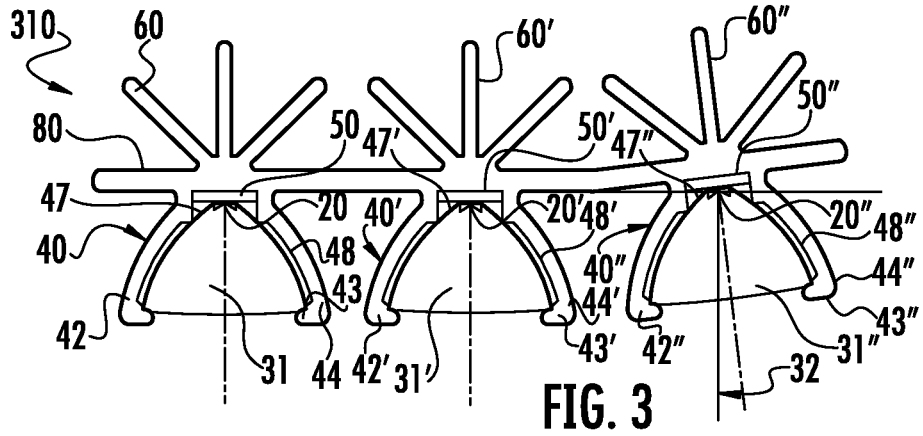
FIG. 3 illustrates a cross sectional view of yet another embodiment of a lighting device in accordance with teachings of the present disclosure, utilizing an array of LEDs wherein an axis of one or more optical elements is rotated by an angle.

Yet another embodiment of a lighting device 310 is illustrated in FIG. 3. As generally depicted, FIG. 3 illustrates a further embodiment wherein two or more support structures 40, 40', and 40" are combined or extruded as a single multi-support structure 80. Multi-support structure 80 includes two or more LED light strips 50, 50', and 50" and two or more optical elements, such as TIR optics 31, 31' and 31", arranged laterally to provide greater illumination for an area or surface. Thus, multi-support structure 80 includes at least first and second receiving areas 47 and 47' formed therein for receiving and retaining first and second substrates 50 and 50' having a first plurality of light emitting diodes 20 and a second plurality of light emitting diodes 20' mounted thereon, respectively. In addition, lighting device 310 includes fins 60 formed within support structure 40 and fins 60' formed within the support structure 40' for dissipating heat produced by the first and second plurality of light emitting diodes, 20 and 20'. First and second optical elements 31 and 31', first and second pair of opposing support segments, 42, 43, 42' and 43', are also formed within support structures 40 and 40' for providing first and second optical channels for retaining first and second optical elements 31 and 31' adjacent to first and second plurality of light emitting diodes 20 and 20'. A first and second sealing channel (not shown) may also be formed within first and second end portions of support structures 40 and 40' for containing a first and second sealing member, wherein the first and second sealing members are adapted to seal the first and second support structures, respectively. As illustrated in FIG. 3, multi-support structure 80 may also include a third support structure 40", third substrate 50", third optical element 31", etc.

Multi-support structure 80 may be used, for example, to illuminate a floor area of a building, illuminate a sign, or be used to illuminate a pathway. In this embodiment, individual support structures 40, 40', and 40" are joined to provide a multi-support structure 80 retaining individual optical elements, such as 30 or 31. In one embodiment, one support structure 40" of multi-support structure 80 may be adjusted such that the axis of the corresponding optical element 30 or 31" is rotated by an angle 32 to allow for a different aim of the optical element 30 or 31". Thus, one or more support structures 40" may be angled such that a corresponding at least one optical element 31" is adjusted, thereby changing a light distribution angle of the LED lighting device 310. In addition, any one of optical elements 31, 31' or 31" may adjustable within a corresponding optical channel 48 or 48' to provide for a range of light distributions. One of skill in the art will appreciate that any or all of the optical elements 30 or 31 can be rotated to any angle as desired to provide for a wider or narrow light distribution.

Figure 4:
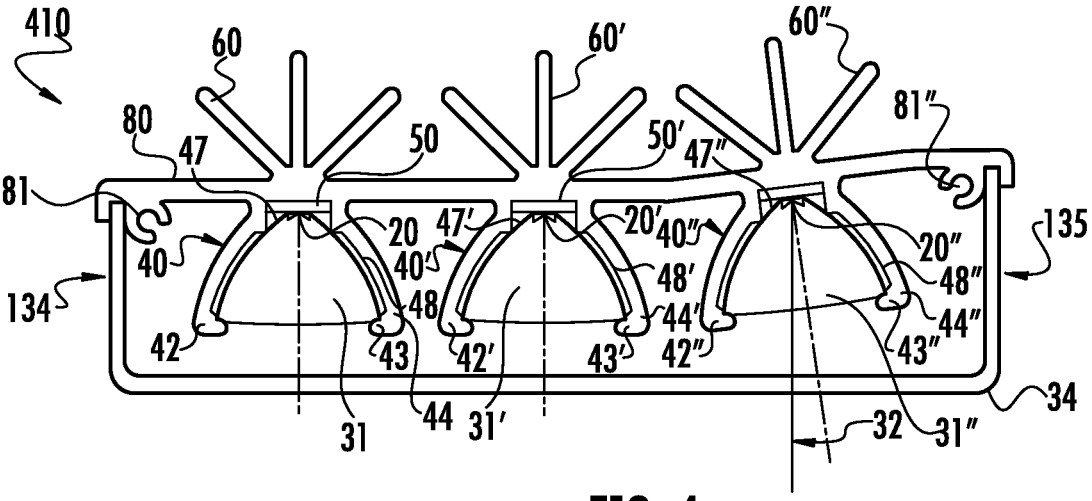
FIG. 4 illustrates a cross sectional view of a further embodiment of a lighting device in accordance with teachings of the present disclosure, wherein a lens covers the entire array of light emitting diodes.

FIG. 4 illustrates a cross sectional view of a further embodiment of a lighting device 410. An additional embodiment of the concept of FIG. 3 is illustrated in FIG. 4 where outer lens 34 covers the complete group of arrays 50. Provision for a glue channel 82 (see FIG. 5) is made in multi-support structure 80 to attach and seal lighting device 410. End caps (not shown) that seal to outer lens 34 and multi-support structure 80 are attached by thread forming screw engaging semi-circular cavities 81 in multi-support structure 80. This embodiment may without limitation also include angular rotation 32 or otherwise include a displacement of one or more arrays/substrates 50, 50' and 50" to control the light beam pattern. Outer lens 34 includes first and second side portions 134 and 135, wherein side portion 135 is longer than side portion 134 to facilitate the angular rotation 32 of substrate 50" and support structure 40".

Figure 5:
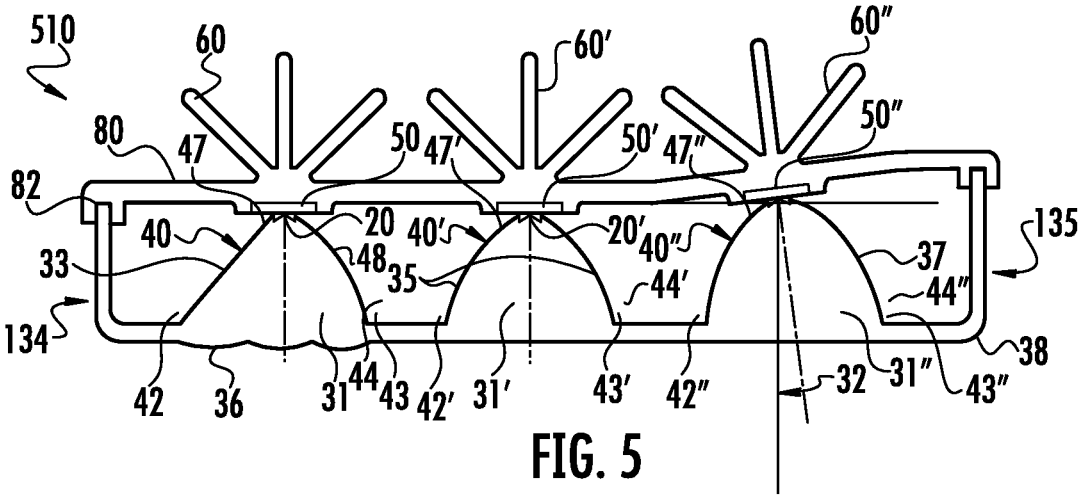
FIG. 5 illustrates a cross sectional view of still a further embodiment of a lighting device in accordance with teachings of the present disclosure, the device characterized by an optical element and lens, which are integrally-formed.

FIG. 5 generally illustrates a cross sectional view of still a further embodiment of a lighting device 510 in accordance with teachings of the present disclosure. Lighting device 510 includes an integral lens 38 including individualoptical elements 33, 35 and 37 combined with an outer lens. Integral lens 38 may be molded or extruded in clear or colored plastics and may include secondary optical elements 36 on the outer surface of the lens for additional light control. An integral lens may also be used in embodiments having a single support structure 40 and single optical element 30. In addition, the embodiment of FIG. 5 illustrates another variable wherein optical elements 33, 35, and 37 vary in shape between individual arrays of LEDs/substrates 50, 50' and 50" and support structures 40, 40', and 40".

The foregoing descriptions of specific embodiments of the present invention have been presented for purposes of illustration and description. They are not intended to be exhaustive or to limit the invention to the precise forms disclosed, and various modifications and variations are possible in light of the above teachings. The embodiments were chosen and described in order to explain the principles of the invention and its practical application, to thereby enable others skilled in the art to utilize the invention and various embodiments with various modifications as are suited to the particular use contemplated.

What is claimed is:

1. A multi-support structure for use in an LED lighting device comprising:

a first support structure having:

a first receiving area formed therein for receiving and retaining a substrate having a plurality of light emitting diodes mounted thereon;

a first fin integral with the support structure for dissipating heat produced by the plurality of light emitting diodes;

a first optical element;

a first pair of opposing support segments formed within the support structure for providing an optical channel for retaining the optical element adjacent to the plurality of light emitting diodes; and a second support structure having:

a second receiving area formed therein for receiving and retaining a second substrate having a second plurality of light emitting diodes mounted thereon;

a second fin formed within the support structure for dissipating heat produced by the second plurality of light emitting diodes;

a second optical element;

a second pair of opposing support segments formed within the support structure for providing a second optical channel for retaining the second optical element adjacent to the second plurality of light emitting diodes; and wherein the first support structure and the second support structure are capable of being individually angled such that the first optical element or second optical element are adjusted for changing a light distribution angle.

2. The multi-support structure of claim 1 wherein the multi-support structure is formed from aluminum.

3. The multi-support structure of claim 1 wherein the first and second pairs of opposing support segments are configured such that the first and second optical channels are circular, semi-circular, a rectangular, or triangular.

4. The multi-support structure of claim 1 wherein the multi-support structure is a metal extrusion.

5. The multi-support structure of claim 1 further including a sealing member that is an O-ring.

6. The multi-support structure of claim 1 wherein the first and second optical elements are selected from a group consisting of a clear rod, a translucent rod, a colored rod, and a total internal reflection (TIR) lens.

7. An LED lighting device comprising:

a plurality of light emitting diodes (LEDs) mounted on at least one substrate;

at least one optical element;

a first support structure formed from a thermally conductive material, said first support structure including at least one receiving area formed therein for receiving and retaining said substrate;

at least one fin integral with the first support structure for dissipating heat produced by the plurality of light emitting diodes;

at least one pair of opposing support segments formed within the first support structure for providing an optical channel for retaining the optical element adjacent to the plurality of light emitting diodes; and at least one pair of retaining elements extending from said pair of opposing support segments for holding said optical element in place;

a second support structure integral with the first support structure and formed from a thermally conductive material, said second support structure including a second receiving area formed therein for receiving and retaining a second substrate;

a second fin integral with the second support structure for dissipating heat produced by a second plurality of light emitting diodes;

a second optical element;

a second pair of opposing support segments formed within the second support structure for providing a second optical channel for retaining the second optical element adjacent to the second plurality of light emitting diodes; and a second pair of retaining elements extending from said second pair of opposing support segments for holding said second optical element in place; and wherein the first support structure and second support structure are capable of being individually angled such that the at least one optical element or second optical element is adjusted, thereby changing a light distribution angle of the LED lighting device.

8. The LED lighting device of claim 7 wherein the at least one substrate is a printed circuit board.

9. The LED lighting device of claim 7 wherein the at least one optical element is selected from a group consisting of a clear rod, a translucent rod, a colored rod, and a total internal reflection (TIR) lens.

10. The LED lighting device of claim 7 wherein the at least one pair of opposing support segments are configured such that the optical channel is circular, semi-circular, a rectangular, or triangular.

11. The LED lighting device of claim 7 wherein the first support structure is a metal extrusion.

12. The LED lighting device of claim 11 wherein the first support structure comprises a plurality of extrusions joined to form a singular structure.

13. The LED lighting device of claim 7 wherein the at least one optical element is adjustable to provide for a range of light distributions.

14. The LED lighting device of claim 7 wherein a sealing member is located between the first support structure and the at least one optical element.

15. The LED lighting device of claim 7 wherein the first support structure comprises a plurality of fins.

16. The LED lighting device of claim 7 wherein the first and second optical elements are selected from a group consisting of a clear rod, a translucent rod, a colored rod, and a total internal reflection (TIR) lens.

17. An LED lighting device comprising:

a first plurality and second plurality of light emitting diodes;

a first optical element and a second optical element;

a multi-support structure including first and second support structures each having a receiving area for receiving one of the first and second pluralities of light emitting diodes, said first and second support structures each further including a pair of opposing support segments for retaining one of the first and second optical elements adjacent to the first and second pluralities of light emitting diodes; and wherein the first support structure and second support structure are capable of being individually angled such that one or both of the first optical element and second optical element is adjusted, thereby changing a light distribution angle of the LED lighting device.

18. The LED lighting device of claim 17, further comprising an outer lens for covering the first and second optical elements.

19. The LED lighting device of claim 18, wherein the outer lens includes secondary optical elements disposed on an outer surface of the outer lens for providing additional light control.

20. The LED lighting device of claim 18, wherein the first and second optical elements and the outer lens are an integral piece.

* * * * *